US011497098B2

(12) United States Patent
Hoeflinger et al.

(10) Patent No.: US 11,497,098 B2
(45) Date of Patent: Nov. 8, 2022

(54) METHOD FOR CONTROLLING A CURRENT OF A LIGHT-EMITTING DIODE

(71) Applicant: OSRAM OLED GMBH, Regensburg (DE)

(72) Inventors: Benjamin Hoeflinger, Regensburg (DE); Matthias Goldbach, Pentling (DE)

(73) Assignee: OSRAM OLED GMBH, Regensburg (DE)

( * ) Notice: Subject to any disclaimer, the term of this patent is extended or adjusted under 35 U.S.C. 154(b) by 0 days.

(21) Appl. No.: 16/769,223

(22) PCT Filed: Jan. 11, 2019

(86) PCT No.: PCT/EP2019/050617
§ 371 (c)(1),
(2) Date: Jun. 2, 2020

(87) PCT Pub. No.: WO2019/138029
PCT Pub. Date: Jul. 18, 2019

(65) Prior Publication Data

US 2021/0100084 A1 Apr. 1, 2021

(30) Foreign Application Priority Data

Jan. 12, 2018 (DE) ..... 102018100598.9

(51) Int. Cl.
*H05B 45/58* (2020.01)
*H05B 45/14* (2020.01)
(Continued)

(52) U.S. Cl.
CPC ..... *H05B 45/58* (2020.01); *H05B 45/10* (2020.01); *H05B 45/14* (2020.01); *H05B 45/28* (2020.01);
(Continued)

(58) Field of Classification Search
CPC ..... H05B 45/14; H05B 45/18; H05B 45/28; H05B 45/58; H05B 45/325; H05B 47/11; H05B 47/14; H05B 47/16; H05B 47/105
See application file for complete search history.

(56) References Cited

U.S. PATENT DOCUMENTS 6,048,397 A * 4/2000 Endo ..... H01L 33/305 117/103
6,211,626 B1 * 4/2001 Lys ..... G09G 3/2014 315/324
(Continued)

FOREIGN PATENT DOCUMENTS

CN 107240551 A * 10/2017 ..... H05B 47/18
DE 102005018175 A1 10/2006
(Continued)

OTHER PUBLICATIONS

International Search Report in corresponding International Application No. PCT/EP2019/050617 dated Mar. 11, 2019.

*Primary Examiner* — Abdullah A Riyami
*Assistant Examiner* — Syed M Kaiser
(74) *Attorney, Agent, or Firm* — ArentFox Schiff LLP

(57) ABSTRACT

The invention relates to a method for controlling a current to a light-emitting diode in order for it to emit a desired light flux, wherein the current is determined depending on a time period during which the light-emitting diode is supplied with current, in order to generate the desired light flux for said light-emitting diode.

17 Claims, 3 Drawing Sheets

Figure 1:
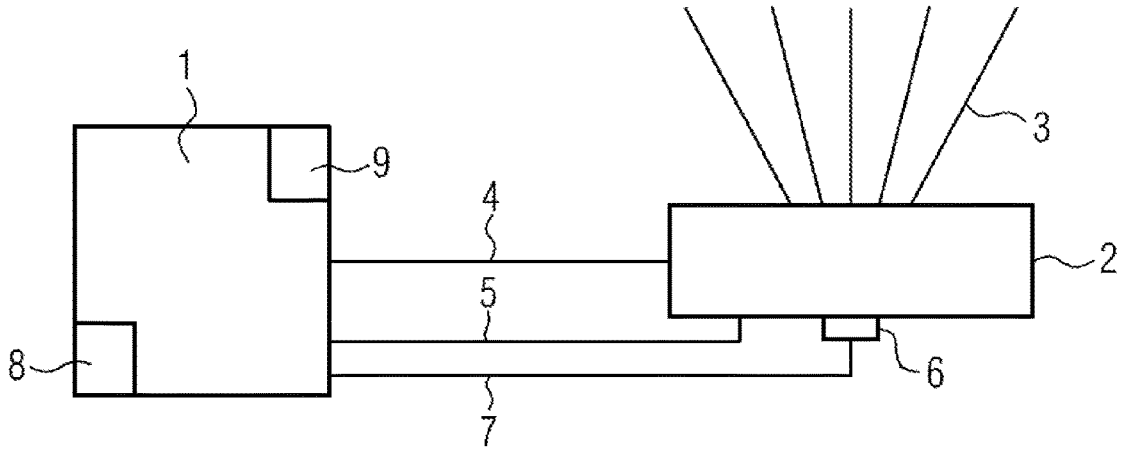

(51) Int. Cl.

| | |
|---|---|
| ***H05B 47/16*** | (2020.01) |
| ***H05B 47/14*** | (2020.01) |
| ***H05B 45/325*** | (2020.01) |
| ***H05B 47/28*** | (2020.01) |
| ***H05B 45/10*** | (2020.01) |
| ***H05B 45/28*** | (2020.01) |
| *H05B 45/18* | (2020.01) |

(52) U.S. Cl.
CPC ..... *H05B 45/325* (2020.01); *H05B 47/14* (2020.01); *H05B 47/16* (2020.01); *H05B 47/28* (2020.01); *H05B 45/18* (2020.01)

(56) References Cited

U.S. PATENT DOCUMENTS 6,340,868 B1 * 1/2002 Lys ..... G09G 3/2014 315/185 S
10,187,947 B2 * 1/2019 Chen ..... G08B 15/00
10,436,422 B1 * 10/2019 Takacs ..... F21V 17/105
2004/0052076 A1 * 3/2004 Mueller ..... F21V 23/0442 362/293
2006/0097507 A1 * 5/2006 Toyota ..... B62D 25/20 280/834
2009/0079357 A1 * 3/2009 Shteynberg ..... H05B 45/20 315/291
2009/0079358 A1 * 3/2009 Shteynberg ..... H05B 45/3725 315/291
2010/0207534 A1 * 8/2010 Dowling ..... H05B 45/28 313/46
2011/0080110 A1 * 4/2011 Nuhfer ..... H05B 45/44 315/291
2011/0254554 A1 * 10/2011 Harbers ..... G01K 11/00 702/57
2012/0013252 A1 * 1/2012 Eckel ..... H05B 47/18 315/210
2012/0206050 A1 * 8/2012 Spero ..... F21V 19/02 315/152
2013/0301052 A1 * 11/2013 MacGregor ..... G01N 21/27 356/437
2014/0001959 A1 * 1/2014 Motley ..... H05B 45/30 315/149
2014/0192527 A1 * 7/2014 Dowling ..... H05B 45/3725 362/231
2015/0048758 A1 * 2/2015 Carrigan ..... H05B 47/19 315/294
2015/0235840 A1 * 8/2015 Dimitriadis ..... H01L 21/0274 250/492.22
2016/0323972 A1 * 11/2016 Bora ..... F21S 8/04
2016/0338171 A1 * 11/2016 Bhagat ..... H05B 45/58
2017/0050560 A1 * 2/2017 Kuang ..... H05B 45/12
2017/0108793 A1 * 4/2017 Kishi ..... G03G 21/08
2017/0127497 A1 * 5/2017 Baek ..... H05B 47/105
2017/0256688 A1 9/2017 Sciascia et al.

FOREIGN PATENT DOCUMENTS

DE 102013207525 A1 10/2014
DE 102014118440 A1 6/2016
EP 0952757 A2 * 10/1999 ..... H05B 47/20
EP 0952757 A2 10/1999
KR 20100084650 A * 7/2010 ..... H05B 45/3725

* cited by examiner

LEGEND

| | |
|---|---|
| 1 | Control Unit |
| 2 | Light-Emitting Diode |
| 3 | Luminous Flux |
| 4 | Electrical Line |
| 5 | Second Electrical Line |
| 6 | Sensor |
| 7 | Sensor Line |
| 8 | Timer |
| 9 | Memory |

LEGEND

| | |
|---|---|
| 1 | Control Unit |
| 2 | Light-Emitting Diode |
| 4 | Electrical Line |
| 5 | Second Electrical Line |
| 6 | Sensor |
| 7 | Sensor Line |
| 8 | Timer |
| 9 | Memory |
| 10 | Second Light-emitting Diode |

METHOD FOR CONTROLLING A CURRENT OF A LIGHT-EMITTING DIODE

CROSS REFERENCE TO RELATED APPLICATIONS

This application is a 35 U.S.C. § 371 National Phase of PCT Application No. PCT/EP2019/050617 filed Jan. 11, 2019, entitled "METHOD FOR CONTROLLING A CURRENT OF A LIGHT-EMITTING DIODE," which claims priority to German patent application 102018100598.9 filed Jan. 12, 2018, the entire contents of each of which are hereby incorporated by reference.

The invention relates to a method for controlling a current of a light-emitting diode and a control unit for carrying out the method.

Activating light-emitting diodes in dependence on the desired luminous flux using different amperages and/or current signals is known in the prior art.

The object of the invention is to provide a method, using which a desired luminous flux can also be generated with the aid of the light-emitting diode over a longer period of time.

The object of the invention is achieved by the independent patent claims.

One advantage of the proposed method is that the desired luminous flux can also be generated with increasing age of the light-emitting diode. This is achieved in that the current for activating the light-emitting diode is ascertained in dependence on a time during which the light-emitting diode was energized. The light-emitting diode is then activated using the ascertained current. In this manner, it is possible to compensate for aging of the light-emitting diode, which is dependent on the period of time of the energizing, by way of a correspondingly modified specification of the current. The desired luminous flux can thus be generated independently of the age and of the performed operation of the light-emitting diode.

In one embodiment, the current for activating the light-emitting diode is additionally determined in dependence on an operating parameter during the energizing. In this manner, it is possible to compensate for aging of the light-emitting diode more accurately. The desired luminous flux can thus be generated more precisely independently of the age and of the performed operation of the light-emitting diode. In this case, in a simple embodiment the time can be taken into consideration in that in each case after a predetermined period of time, the current for activating the light-emitting diode is increased in dependence on an operating parameter. The time of the energizing is thus implicitly taken into consideration in that the current for activating is always increased after the predetermined period of time in dependence on the operating parameter. In a simple embodiment, the current is increased proportionally to the operating parameter after every period of time. A storage of a history of the values of the operating parameter can thus be omitted. The method is thus simplified.

In a further embodiment, the operating parameter represents a temperature of the light-emitting diode. The temperature of the light-emitting diode during the energizing is a parameter which influences the aging behavior of the light-emitting diode. The higher the temperature, the faster the light-emitting diode ages.

In one embodiment, the current is ascertained in dependence on the time of the energizing and preferably in dependence on the operating parameter during the energizing with the aid of at least one formula and/or with the aid of at least one table and/or with the aid of at least one theoretical model. Depending on the selected embodiment, simple means such as a table, more accurate means such as a formula, or very precise means such as a model can thus be used to ascertain the current.

In one embodiment, the operating parameter represents an amperage and/or a frequency of the current, using which the light-emitting diode was activated. Both the amperage and also the frequency of the current represent technical parameters which influence the aging of the light-emitting diode. At a high amperage and a high frequency of the current, the light-emitting diode ages faster than at a lower amperage and a lower frequency. Moreover, the current signal can be formed as a pulse-width-modulated current signal, wherein the operating parameter represents a duty cycle of the pulse-width-modulated current signal, using which the light-emitting diode was activated.

In a further embodiment, the operating parameter represents an ambient humidity at the light-emitting diode. The ambient humidity is also a significant parameter which influences the aging of the diode. The light-emitting diode ages faster at a higher ambient humidity than at a lower ambient humidity.

Furthermore, in dependence on the selected embodiment, a presence of a predetermined gas, in particular a concentration of a gas at the light-emitting diode, can be taken into consideration as an operating parameter. The predetermined gas is, for example, a corrosive gas which accelerates aging of the light-emitting diode.

In a further embodiment, at least two light-emitting diodes are provided, wherein the light-emitting diodes generate electromagnetic radiations having different wavelength ranges, wherein a separate current value is ascertained for each of the two light-emitting diodes, and wherein the two light-emitting diodes are each supplied with the ascertained current value. In this manner, different light-emitting diodes can be activated using individual current values. Moreover, the aging behavior of the light-emitting diodes can also be different in dependence on the type of the light-emitting diodes.

In a further embodiment, the current for activating the light-emitting diode is ascertained according to predeterminable or predetermined periods of time. The light-emitting diode is subsequently activated using the newly ascertained current. Depending on the selected embodiment, the current for the activation of the light-emitting diode is repeated regularly, in particular at time-discrete intervals.

In one embodiment, a pulse-width-modulated current signal is used as the current for activating the light-emitting diode, wherein the duty cycle of the pulse-width-modulated current signal is increased in dependence on the temperature of the light-emitting diode. The present temperature or an average temperature during a last period of time can be used in this case.

In one embodiment, a pulse-width-modulated current signal is used as the current for activating the light-emitting diode. The duty cycle of the pulse-width-modulated current signal is defined in dependence on an operating parameter of the light-emitting diode which existed during the energizing of the light-emitting diode. The operating parameter can represent an amperage, a voltage, or a frequency of the current and/or a duty cycle of a pulse-width-modulated current signal. Moreover, the time during which the light-emitting diode was energized can be taken into consideration.

In a further embodiment, the current for activating the light-emitting diode, in particular a duty cycle of a pulse-width-modulated current signal, is increased in dependence on a chronological change of the luminous flux degradation of the light-emitting diode. In this case, the presently existing luminous flux degradation is used. The chronological change of the luminous flux degradation can be ascertained with the aid of tables, formulas, and/or characteristic curves.

In one embodiment, the light-emitting diode is activated using a pulse-width-modulated current signal. The duty cycle of the pulse-width-modulated current signal can be increased proportionally to the decrease of the luminous flux in order to keep the luminous flux essentially constant even upon aging of the light-emitting diode.

In one embodiment, the duty cycle of the pulse-width-modulated current signal is increased proportionally by the value of the time derivative of the luminous flux degradation of the light-emitting diode to keep the luminous flux substantially constant even upon aging of the light-emitting diode.

Figure 2:
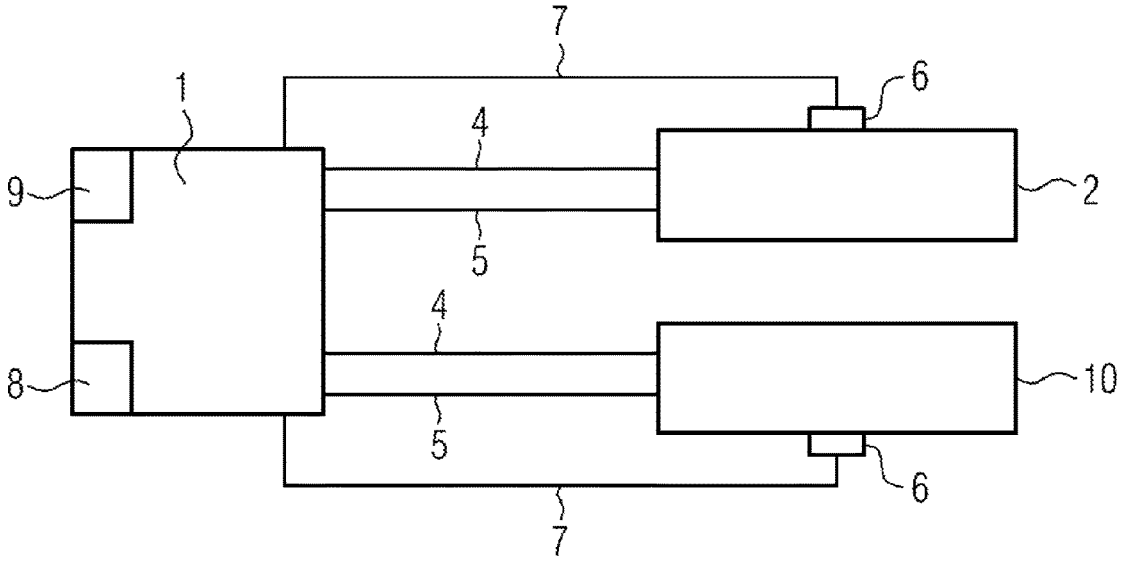
Figure 3:
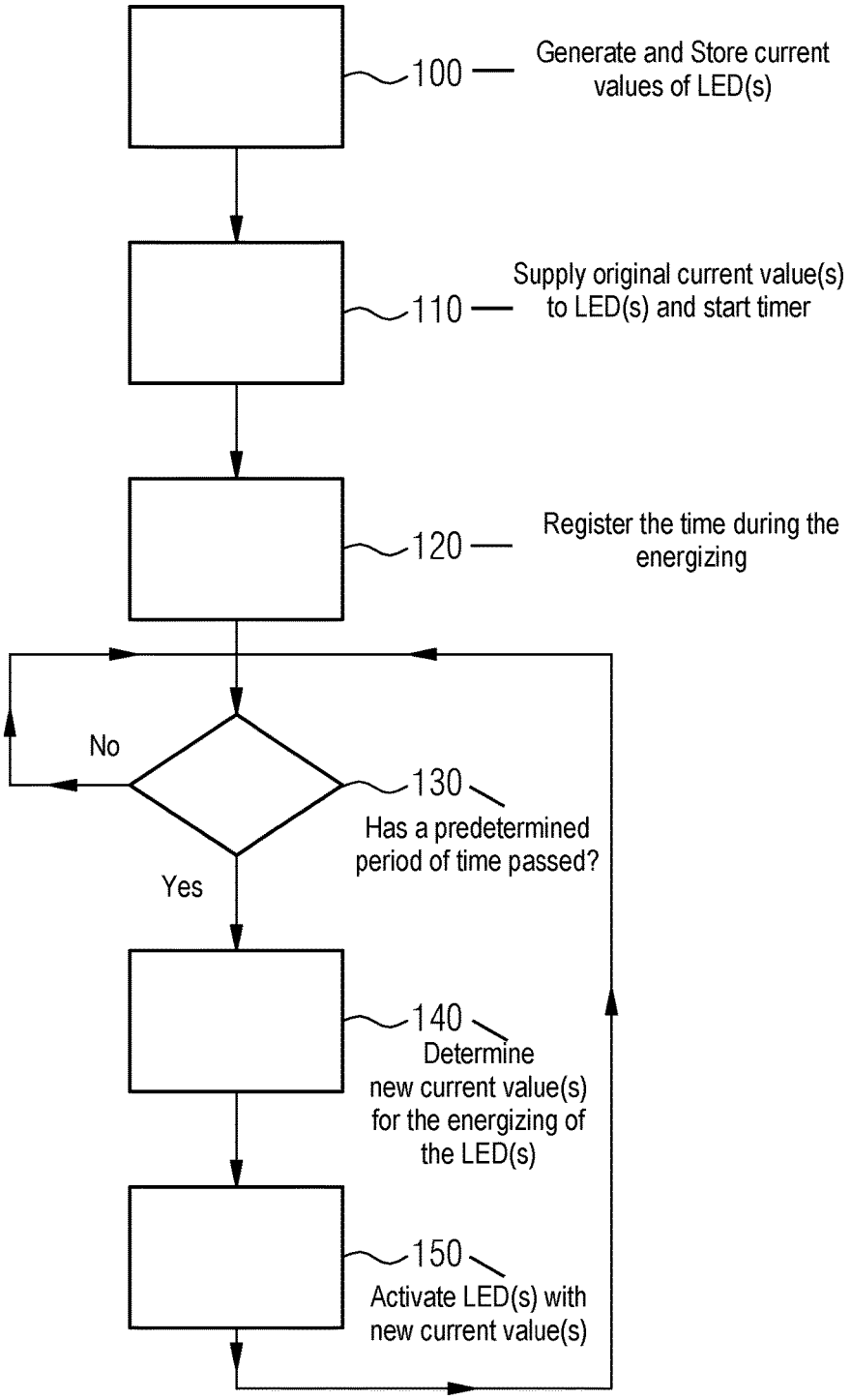

The above-described properties, features, and advantages of this invention and the manner in which they are achieved will become clearer and more comprehensible in conjunction with the following description of the exemplary embodiments, which are explained in greater detail in conjunction with the drawings. In the figures FIG. 1 shows a schematic illustration of a control unit and a light-emitting diode, FIG. 2 shows a schematic illustration of a control unit which activates two light-emitting diodes, and FIG. 3 shows a schematic program sequence for controlling the current of a light-emitting diode.

FIG. 1 shows a control unit 1, which is connected via electrical lines 4, 5 to electric terminals of a light-emitting diode 2. The light-emitting diode 2 is designed to generate a luminous flux 3 upon a corresponding activation using current via the electrical lines 4, 5. Moreover, at least one sensor 6, which is connected via a sensor line 7 to the control unit, can be provided at the light-emitting diode 2. Depending on the selected embodiment, various sensors 6 can be provided at the light-emitting diode 2.

The control unit 1 can have a timer 8, using which the control unit 1 can measure a passage of time. Moreover, the control unit 1 can have a memory 9. Methods and/or programs and/or tables and/or formulas are stored in the memory 9, which specify the current with which the light-emitting diode 2 has to be activated to generate a desired luminous flux 3. These data correspond to the properties of a new light-emitting diode 2, which does not yet have any significant aging. For example, the current values for the desired luminous fluxes are measured after the production of the light-emitting diode 2 and written in the memory 9. Furthermore, a formula and/or a table and/or a characteristic curve and/or a theoretical model can be stored in the memory 9, using which aging of the light-emitting diode is taken into consideration for the ascertainment of the current for a desired luminous flux.

The formulas, tables, characteristic curves, and/or models are designed to ascertain, in dependence on a time during which the light-emitting diode was energized, in dependence on the current, and in particular in dependence on an operating parameter during the energizing, the current which is necessary for a desired luminous flux. Different currents are computed in dependence on the various desired luminous fluxes.

The control unit 1 is designed to ascertain a current, using which the light-emitting diode has to be activated to emit a defined luminous flux. For this purpose, the control unit 1 can register a time during the energizing with the aid of the timer 8. Furthermore, the current level and the current frequency are known to the control unit 1, since the control unit 1 supplies the light-emitting diode 2 with the current. Moreover, the control unit 1 can register at least one operating parameter of the light-emitting diode via the at least one sensor 6. For example, a temperature of the light-emitting diode and/or an ambient humidity in the region of the light-emitting diode and/or a presence and/or a concentration of a predetermined gas at the light-emitting diode can be registered as operating parameters. The predetermined gas can be a corrosive gas, for example, $NO_x$ or $H_2S$.

FIG. 2 shows the arrangement according to FIG. 1, wherein a second light-emitting diode 10 is provided, the electric terminals of which are connected to electrical lines 4, 5 of the control unit 1. Moreover, at least one sensor 6 is provided at the second light-emitting diode 10 to register at least one operating parameter of the second light-emitting diode 10 and transmit it to the control unit 1. The two light-emitting diodes 2, 10 generate, for example, electromagnetic radiations having different wavelength ranges. The control unit 1 is designed to ascertain an individual current value for each light-emitting diode 2, 10, in the case of which the aging of the light-emitting diodes is taken into consideration and the desired luminous fluxes are generated by the two light-emitting diodes.

Depending on the selected embodiment, the two light-emitting diodes can be constructed differently and in particular can comprise different materials, in particular different semiconductor materials. The two light-emitting diodes 2, 10 can thus also have a different aging behavior. In this embodiment, for example, a corresponding formula and/or table and/or characteristic curve and/or a theoretical model is thus stored in the memory 9 for each light-emitting diode 2, 10, using which the aging behavior of the light-emitting diode is taken into consideration for the ascertainment of the current for generating a desired luminous flux.

FIG. 3 shows a schematic illustration of a program sequence, using which an activation of the light-emitting diodes is carried out, wherein aging of the light-emitting diode is compensated for. At program point 100, current values for the light-emitting diodes, using which desired luminous fluxes are generated, are stored in the memory 9 of the control unit 1. Moreover, a formula, characteristic curve, table, and/or a theoretical model are stored in the memory 9, using which an aging behavior of the light-emitting diodes is taken into consideration during the ascertainment of the current.

At program point 110, the control unit 1 supplies the light-emitting diodes 2, 10 with the original current values for the emission of a desired luminous flux. Simultaneously with the energizing at program point 110, the timer 8 is started.

Simultaneously, at program point 120, the control unit 1 registers the time during the energizing, the amperage, and/or the current frequency, using which the light-emitting diodes are energized. Moreover, the control unit 1 can register a further operating parameter during the energizing at program point 120. For this purpose, the temperature of the light-emitting diodes, the ambient humidity in the region of the light-emitting diodes, and/or the presence of a predetermined gas, in particular the presence of a concentration of a predetermined gas at the light-emitting diode, are registered, for example, using sensors 6. The predetermined gas represents a corrosive gas which accelerates aging of the light-emitting diode.

At program point 130, the control unit 1 checks whether a predetermined period of time, for example, one second, has passed. If this is not the case, the sequence thus passes through program point 130 again and the light-emitting diodes are still provided with the present current value.

However, if the query at program point 130 has the result that the predetermined period of time has passed, at program point 140, a new current value for the energizing of the light-emitting diodes for the same desired luminous flux is thus ascertained by the control unit 1. For this purpose, the formulas, tables, characteristic curves, and/or theoretical models stored in the memory 9 are used. Depending on the selected embodiments, different formulas, tables, characteristic curves, and/or theoretical models can be provided for the two light-emitting diodes 2, 10. Moreover, the formulas, characteristic curves, tables, and/or theoretical models can at least take into consideration the current during the energizing and/or the period of time during the energizing and/or a further operating parameter, for example, the temperature of the light-emitting diodes, the ambient humidity of the light-emitting diodes, and/or the presence of a corrosive gas.

Subsequently, at program point 150, the light-emitting diodes are activated by the control unit 1 using the recomputed current values. Moreover, the timer 8 is restarted to measure the period of time of the energizing using the new current value. Subsequently, the sequence branches back to program point 130 and passes through the method again.

The formulas, characteristic curves, tables, and/or theoretical models can take into consideration at least one of the following formulas: In this case, an aging model can be used which describes a luminous flux degradation with the operating lifetime of the light-emitting diode according to following formula 1:

$$L(t) = \frac{\Phi(t)}{\Phi_0(t_0)} = \frac{\Phi_0 - \Phi_E}{\Phi_0} * e^{-\alpha t} + \frac{\Phi_E}{\Phi_0} \tag{1}$$

The luminous flux for the time $t \to \infty$ is denoted by $\Phi_E$.

The initial luminous flux at the point in time to is denoted by $\Phi_0(t_0)$. A constant is denoted by $\alpha$.

A degradation factor for the luminous flux is denoted by $L(t_0)$, which is equal to 1 at the point in time $t_0$. The period of time of the operation of the light-emitting diode, i.e., the period of time of the energizing, is denoted by t.

Formula 1 can be converted into following formula 2:

$$t = -\frac{1}{2} \cdot \ln\left(\frac{\Phi_0 L(t) - \Phi_E}{\Phi_o - \Phi_E}\right) \tag{2}$$

Moreover, the temperature of the light-emitting diode can be taken into consideration using a temperature acceleration model according to formula 3, wherein tau denotes an acceleration coefficient:

$$\text{tau} = \text{tau}_0 \cdot \exp\left(\frac{E_a}{k}\left(\frac{1}{T} - \frac{1}{T_0}\right)\right) \tag{3}$$

with $T_0$ as the reference temperature, with T as the measured temperature, with Ea as the activation energy for the aging, and with k as the Boltzmann constant.

The model specifies a relationship between the degradation at reference temperature $T_0$ and the actual temperature T of the light-emitting diode. For example, the half luminous flux L(t1)=0.5*L(t=0) at $T_0$ is reached after a time t1. If the degradation takes place at a higher temperature T than $T_0$, the half luminous flux is already reached after t2=t1*tau(T, $T_0$).

There is a quantitative relationship between $T_j$ and $V_{FLED}$ according to following formula 4:

$$V_{FLED} = V_{FLED}(25^\circ\text{ C.}) + T_{CV}(T_j - 25^\circ\text{ C.}) \tag{4}$$

$V_{FLED}$ (25° C.): fixed voltage value at the reference temperature of 25° C., for example, measured during the test in the package production.

$T_{CV}$: thermal coefficient of the forward voltage, which is specific for every light-emitting diode.

$T_j$: $T_{junction}$: temperature of the active zone (pn junction) of the light-emitting diode.

Moreover, following formula 5 can be used:

$$= > T_j = \frac{V_{FLED} - V_{FLED}(25^\circ\text{ C.})}{T_{CV}} + 25^\circ\text{ C.} \tag{5}$$

$V_{FLED}$ measured value for the registered operating voltage, which is registered, for example, by the control unit (ASIC) at the present point in time.

With the aid of equation 5, the temperature $T_j$ at the pn junction of the light-emitting diode may be ascertained from the operating voltage registered by the control unit.

Moreover, a relationship between $T_j \leftrightarrow T_s \leftrightarrow$ Pel=U·J can be taken into consideration in the computation.

There is the following relationship of equation 6 between $T_j$ of the light-emitting diode, the temperature $T_s$ directly registered by the control unit, and the electric power of the light-emitting diode:

$$P_{el} = U \cdot I \leftrightarrow \text{actual } \bar{I} = I_{max} \cdot c(\text{PWM-dimming}) \tag{6}$$

$P_{el}$: electric power c: duty cycle of the PWM activation of the LED

The luminous flux of the light-emitting diode is dependent on the temperature Tj of the pn junction of the light-emitting diode, as can be described using following equation 7.

$$P_{opt} = P_{opt_0}(25^\circ\text{ C.})(1 + T_{ci}(T_j - 25^\circ\text{ C.}) \tag{7}$$

$P_{opt}$: luminous flux of the LED (=Φ)

$T_{ci}$: temperature coefficient of the luminous flux of the light-emitting diode $P_{opt0}$: luminous flux at point in time to at reference temperature, which was determined from test data and is stored in the control unit.

$T_s$: sensor temperature, which is registered by a temperature sensor located, for example, in the control unit (ASIC).

$R_{TH}$ is the thermal resistance between the temperature sensor, which is preferably integrated into the control unit, and the pn junction of the LED. Following formula 8 can thus be established:

$$T_j = R_{TH}(P_{el} - P_{opt}) + T_S \tag{8}$$

If formula 7 is inserted into formula 8, it is thus apparent that the optical power decreases over the operating lifetime of the LED. The reduction of the optical power is taken into consideration by the introduction of the degradation factor L(t), so that the aging of the luminous flux of the LED in dependence on the lifetime can be described according to following equation 9.

$$T_j = R_{TH} \cdot [V_{FLED} \cdot 1 - L(t) P_{opt}(25^\circ\text{ C.})(1 + T_{ci}(T_j - 25^\circ\text{ C.}) + T_S] \tag{9}$$

Equation 9 can be solved for L and results in following equation 10:

$$= > L(t) = -\frac{T_j - T_S - R_{TH}(V_{FLED} \cdot I)}{R_{TH} \cdot P_{opt}(25^\circ\,C.)(1 + T_{ci}(T_j - 25^\circ\,C.)} \quad (10)$$

The degradation factor L(t) can be computed from $T_j$, wherein $T_j$ is ascertained from the measured operating voltage $V_{FLED}$, the temperature $T_S$ registered by the sensor, and the predefined current I at every point in time, without knowing a prior history of the aging or the operating state of the LED.

The current for activating the light-emitting diode can be ascertained, for example, using the following method, wherein the following input variables can be used:

$I_{el}=I_{max}\cdot c$: current is predetermined by the control unit and is thus known.

$V_F=V_{FLED}$: forward voltage, which is registered by the control unit.

$T_S$: sensor temperature is registered by the control unit.

$\Phi_0$: initial luminous flux is stored during the assembly of the light-emitting diode with the control unit in an arrangement in the control unit.

The following computation is carried out by the control unit once for each predetermined period of time, i.e., for each time slice. A period of time can be, for example, 1 second or longer:

Step 1

Ascertainment of the temperature $T_j$ from the registered operating voltage of the LED according to equation 5.

$$T_j(V_F) = \frac{V_F - V_F(25^\circ\,C.)}{T_{CV}} + 25^\circ\,C.$$

Step 2

Ascertainment of the luminous flux degradation at the present point in time t1 according to equation 10.

$$L_{t1}=L_{t1}(V_F, T_S, I_{LED}, T_j(V_F))$$

Step 3

Determination of the time passed under reference condition according to equation 2.

$$t_{25\,^\circ C} = -\frac{1}{2}\ \ln\left(\frac{L(t)\phi_o - \phi_E}{\phi_o - \phi_E}\right)$$

Step 4

Conversion of the operating time passed (period of time) under reference conditions ($t_{25^\circ\,C.}$) to the corresponding operating time $t_{Tj}$ for the aging at the presently ascertained temperature T of the LED:

$$t_{25\,^\circ C} \xrightarrow[\text{Acceleration model}]{\text{Temperature}} t_{T_j}$$

Step 5

Computation of the derivative of the chronological luminous flux change at the point in time $t_{Tj}$.

$L'(t_{T_j})$: Time derivative of equation (1) (slope of the degradation curve) at the point in time $t_{T_j}$, i.e., determination of the first derivative of the aging function at the point in time $t_{T_j}$.

In dependence on the selected embodiment, the time profile of the degradation curve for the light-emitting diode can be experimentally determined and stored in the data memory of the control unit. Moreover, the degradation curve can be numerically computed with the aid of the described formulas.

Step 6

The control unit changes the PWM current signal to compensate for the luminous flux decrease for the next time slice in that the duty cycle of the PWM current signal is multiplied by a factor which corresponds to the time derivative of the luminous flux at the temperature of the light-emitting diode. A time step can be, for example, in the range of minutes or hours. In this case, the chronological change of the duty cycle $d_c(t_1+\Delta t)$ of the PWM current signal can be determined according to the following formula:

$$d_c(t_1+\Delta t)=f(T_s, V_F, I_{LED}, T_j(V_F), \Phi_0)\Delta t + d_c(t_1) \quad \text{General}$$

Especially for our application:

$$f(T_s, V_F, I_{LED}, T_j(V_F), \Phi_0) \sim -L'(t_{T_j})$$

The change of the duty cycle thus occurs proportionally to the negative change of the luminous flux: $\sim -L'(t_{T_j})$. The degradation curve for the luminous flux and its time derivative can be determined analytically or numerically.

With increase of the operating period of the light-emitting diode, the duty cycle of the pulse-width-modulated current signal is increased in each time step by a factor, wherein the factor is defined by the time derivative of the present luminous flux change, i.e., by the time derivative of the luminous flux degradation $L'(t_{T_j})$ at the temperature of the light-emitting diode. Since the luminous flux degradation changes with the operating time of the light-emitting diode, the operating time of the light-emitting diode is taken into consideration by the use of the present luminous flux degradation. For example, the current, in particular a duty cycle of a pulse-width-modulated current signal can be increased in percentage by the value of the time derivative of the luminous flux degradation. For example, if the luminous flux degradation sinks by 10%, the current, in particular a duty cycle of a PWM current signal, is then increased by 10%. The time in which current is applied to the light-emitting diode is thus increased with increase of the operating period of the light-emitting diode.

Using the described method, the storage requirement and the storage time for storing operating parameters of preceding periods of time can be saved. Moreover, the change of the PWM current signal to compensate for the aging of the LED can be computed rapidly and easily. The time change of the luminous flux, i.e., the time derivative of the luminous flux degradation can be computed or estimated easily and is sufficient to take into consideration the aging of the light-emitting diode in the ascertainment of the current for activating the light-emitting diode for generating a desired luminous flux.

If a current signal other than a PWM current signal is used to activate the light-emitting diode, the current signal is then increased similarly to compensate for the aging of the light-emitting diode. For example, in a simple case the amperage of the current signal can be increased.

The invention was illustrated and described in greater detail on the basis of the preferred exemplary embodiments. Nonetheless, the invention is not restricted to the disclosed examples. Rather, other variations can be derived therefrom by a person skilled in the art without leaving the scope of protection of the invention.

LIST OF REFERENCE NUMERALS

1 control unit
2 light-emitting diode
3 luminous flux
4 electrical line
5 second electrical line
6 sensor
7 sensor line
8 timer
9 memory
10 second light-emitting diode

The invention claimed is:

1. A method for controlling a current of a light-emitting diode to emit a desired luminous flux, comprising:

defining, at a predetermined time, the current in dependence on a prior time period during which the light-emitting diode was energized, and in dependence on an operating parameter of the light-emitting diode which existed during the prior time period, and energizing the light-emitting diode using the current to generate the desired luminous flux, wherein a pulse-width-modulated current signal is used as the current, and wherein defining the current comprises increasing a duty cycle of the pulse-width-modulated current signal, at the predetermined time, proportionally by a value of a time derivative of a luminous flux degradation curve of the light-emitting diode corresponding to aging over the lifetime of the light-emitting diode, the aging due to the energizing of the light-emitting diode, the value of the time derivative corresponding to a slope of the luminous flux degradation curve at the predetermined time.

2. The method as claimed in claim 1, wherein the operating parameter represents a temperature of the light-emitting diode during the energizing, in particular the temperature of an active zone of the light-emitting diode.

3. The method as claimed in claim 1, wherein a value for the current is further ascertained in dependence on the time of the energizing and in dependence on the operating parameter during the energizing based on at least one formula and/or based on at least one table and/or based on at least one theoretical model.

4. The method as claimed in claim 1, wherein the operating parameter represents an amperage or a voltage of the current.

5. The method as claimed in claim 1, wherein the operating parameter represents an ambient humidity at the light-emitting diode.

6. The method as claimed in claim 1, wherein the operating parameter represents a presence of a predetermined gas, in particular a concentration of the predetermined gas at the light-emitting diode.

7. The method as claimed in claim 1, wherein at least one second light-emitting diode is provided, wherein the light-emitting diodes generate electromagnetic radiations having different wavelength ranges, wherein one current value is ascertained for each of the two light-emitting diodes, and wherein the two light-emitting diodes are each supplied using the ascertained current value.

8. The method as claimed in claim 1, wherein defining the current for activating the light-emitting diode at the predetermined time is repeatedly ascertained after a periodic predetermined period of time during which the light-emitting diode was energized and subsequently the light-emitting diode is activated using the ascertained current.

9. The method as claimed in claim 1, wherein the duty cycle of the pulse-width-modulated current signal is increased in dependence on a temperature of the light-emitting diode.

10. The method as claimed in claim 1, wherein the current for activating the light-emitting diode is increased in dependence on a chronological change of the luminous flux degradation of the light-emitting diode.

11. The method as claimed in claim 10, wherein the luminous flux degradation of the light-emitting diode is ascertained in dependence on a temperature of the light-emitting diode.

12. The method as claimed in claim 10, wherein the luminous flux degradation of the light-emitting diode is ascertained in dependence on the time of the energizing of the light-emitting diode.

13. A control unit, which is designed to execute the method as claimed in claim 1.

14. The method as claimed in claim 1, wherein the operating parameter further comprises the duty cycle of the pulse-width modulated current signal of the current.

15. The method as claimed in claim 1, wherein the operating parameter further comprises a presence of a corrosive gas.

16. The method of claim 15, wherein the corrosive gas comprises NOx or H2S.

17. The method of claim 1, wherein a value for the current is further defined in dependence on a time step to a next time at which a subsequent current value is to be determined.

* * * * *